US008100713B2

(12) United States Patent
Luo et al.

(10) Patent No.: US 8,100,713 B2
(45) Date of Patent: Jan. 24, 2012

(54) STACKED ELECTRICAL CONNECTOR WITH A NEW TYPE OF SPACER

(75) Inventors: Hong-Jing Luo, Shenzhen (CN); Xin-Yu Wang, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/834,020

(22) Filed: Jul. 12, 2010

(65) Prior Publication Data

US 2011/0009006 A1 Jan. 13, 2011

(30) Foreign Application Priority Data

Jul. 10, 2009 (CN) ..... 2005 2 0305936

(51) Int. Cl.
*H01R 13/73* (2006.01)

(52) U.S. Cl. ..... 439/541.5

(58) Field of Classification Search ..... 439/79, 439/541.5

See application file for complete search history.

(56) References Cited

U.S. PATENT DOCUMENTS 5,219,295 A * 6/1993 Niwa et al. ..... 439/79

FOREIGN PATENT DOCUMENTS

TW M314956 11/2006

* cited by examiner

*Primary Examiner* — Ross Gushi

(74) *Attorney, Agent, or Firm* — Wei Te Chung; Andrew C. Cheng; Ming Chieh Chang

(57) ABSTRACT

An electrical connector includes a row of terminals arranged in the first direction and including contact portions and soldering tails, an insulative housing in which the contact portions of the terminal are arranged and behind which the soldering tails are arranged and a spacer securely attached to the housing to position the soldering tail. The spacer has a top face and a bottom face and a row of through holes running through the top face and the bottom face to receive the corresponding soldering tails thereof. Each of through holes includes a guiding hole communicating with the top face and a receiving hole communicating with the bottom face. The guiding hole defines guiding faces intersecting with the top face to form a frame intersection. The frame intersections are aligned in the first direction while the receiving holes are offset.

11 Claims, 6 Drawing Sheets

STACKED ELECTRICAL CONNECTOR WITH A NEW TYPE OF SPACER

BACKGROUND OF THE INVENTION

1. Field of the Invention

The present invention generally relates to an electrical connector, and particularly to an electrical connector mounted on a printed circuit board.

2. Description of the Prior Art

Serial Advanced Technology Attachment (Serial ATA) connectors provide a storage interface for ATAPI (Advanced Technology Attachment Packet Interface) devices and hard disk drives, which are main storage peripheral devices of computer systems. Conventionally, a Serial ATA connector comprises an insulating housing, a plurality of terminals received in the housing and a spacer employed to be assembled onto the insulative housing with a plurality of positioned holes defined thereon. A plurality of tail portions of the terminals located in two arrays are inserted into the positioning holes. Such Serial ATA connectors can be found in TW Patent No. M314956 issued to WU LIANG-CAI on Nov. 10, 2006. The tail portions are located in a staggered form and received in corresponding positioning holes. But during assembly process, the tail portions might be damaged by the spacer, because the tail portions can not be lead correctly by the positioning holes.

Hence, an improved electrical connector is desired to overcome the disadvantages of the prior art.

BRIEF SUMMARY OF THE INVENTION

Therefore, an object of the present invention is to provide an electrical connector having a position spacer which has guiding means to the terminals.

To fulfill the above-mentioned object, an electrical connector comprises a row of terminals arranged in the first direction and comprising contact portions and soldering tails, an insulative housing in which the contact portions of the terminal are arranged and behind which the soldering tails are arranged and a spacer securely attached to the insulative housing to position the soldering tail. The spacer has a top face and a bottom face and a row of through holes running through the top face and the bottom face to receive the corresponding soldering tails thereof Each of through holes includes a guiding hole communicating with the top face and a receiving hole communicating with the bottom face. The guiding hole defines guiding faces intersecting with the top face to form a frame intersection. The frame intersections of the row of through holes are aligned in the first direction while the receiving holes of the row of the through holes are offset in the first direction.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
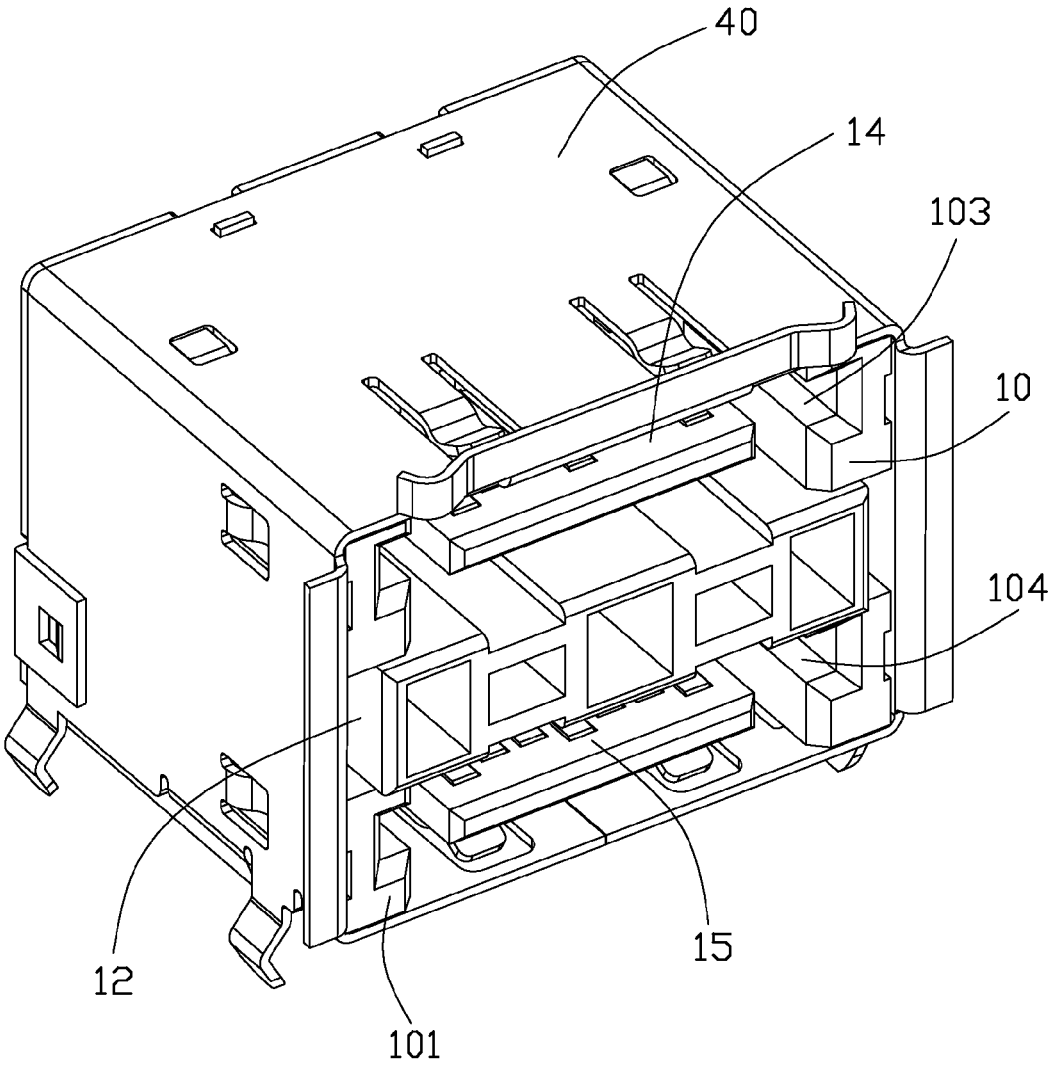
FIG. 1 is a perspective view of an electrical connector made in accordance with the present invention.

Reference will now be made in detail to the preferred embodiment of the present invention.

With reference to FIGS. 1-4, a multiple-port electrical connector 1 in accordance with the present invention, which is mountable on a printed circuit board (not shown), comprises an insulative housing 10, a plurality of terminals 20 disposed in the housing 10, a positioning spacer 30 attached onto the housing 10, and a metal shell 40 secured to the housing 10.

Figure 2:
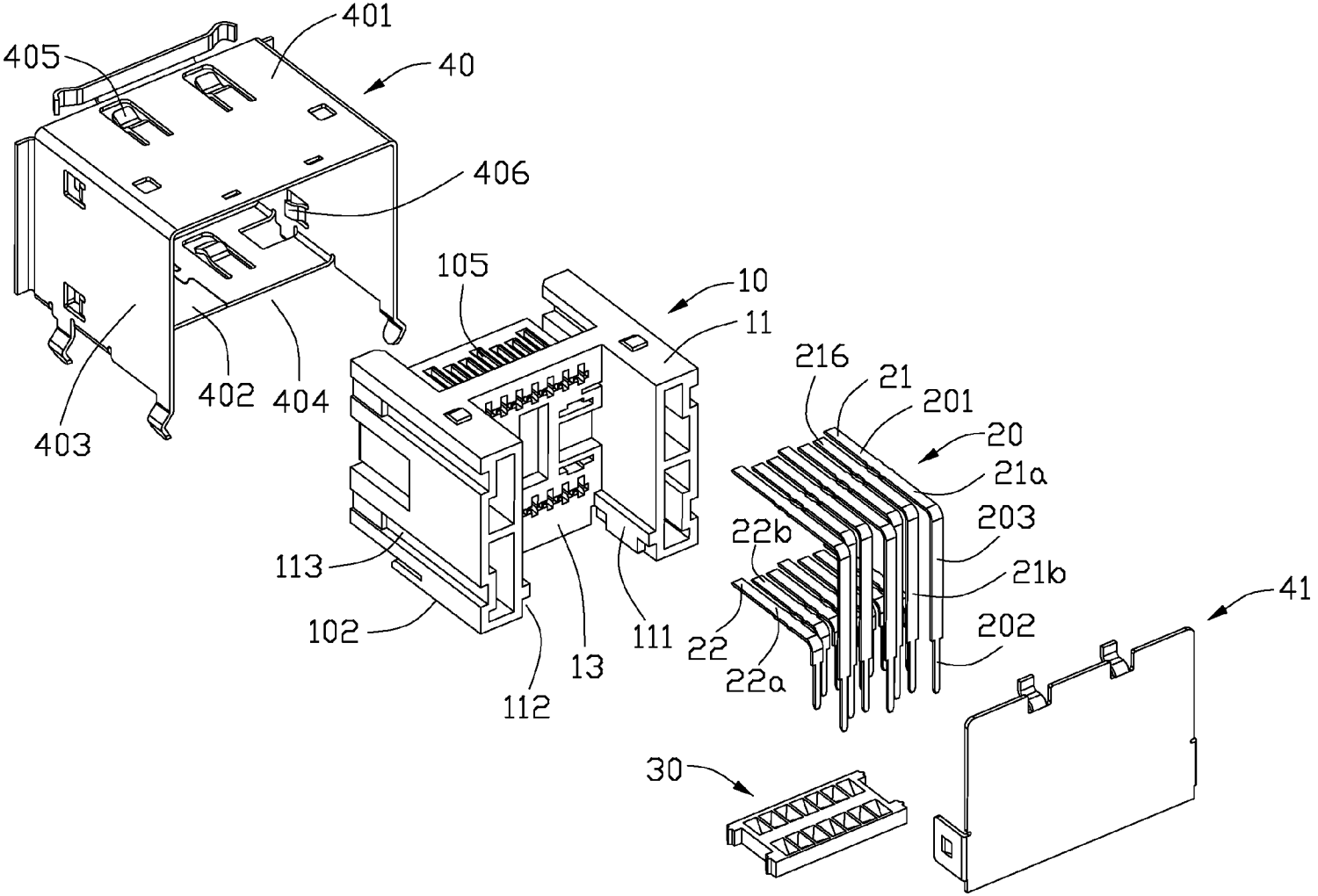
FIG. 2 is an exploded, perspective view of the electrical connector shown in FIG. 1.

Referring to FIG. 2 combination with FIG. 1, The insulative housing 10 comprises a pair of side walls 11 extending parallel to each other, a partition wall 12 extending horizontally between the two side walls 11, and a middle wall 13 extending perpendicularly to the partition wall 12 and connecting the two side walls 11. A first cavity 103 and a second cavity 104 are respectively defined by the side walls 11 and the partition wall 12 for receiving corresponding mating complementary connectors (not shown) therein. The insulative housing 10 also defines a mating face 101 on a front side thereof and a board-mounting face 102 on a bottom side thereof, which is orthogonal to the mating face 101. A first mating tongue 14 extends forwardly in the first cavity 103 from the middle wall 13 to the mating face 101. Similarly, a second mating tongue 15 extends forwardly in the second cavity 104 from the middle wall 13 to the mating face 101. The second mating tongue 15 is substantially formed below the first mating tongue 14. Each mating tongue 14, 15 defines a plurality of passageways 105 in an upper surface thereof The passageways 105 run through the middle wall 13.

Particularly referring to FIG. 2, each side wall 11 comprises a block 111 defined on each inner side face thereof. A pair of slots 112 are formed by the block 111 and the side wall 11 in a bottom side, the pair of slots 112 communicates with the board mounting face 102. The block 111 and the slots 112 are configured for engaging the spacer 30. A pair of grooves 113 are defined upper and lower respectively in each outer face of the side wall 11 and parallel to each other in the upper and lower position.

Figure 3:
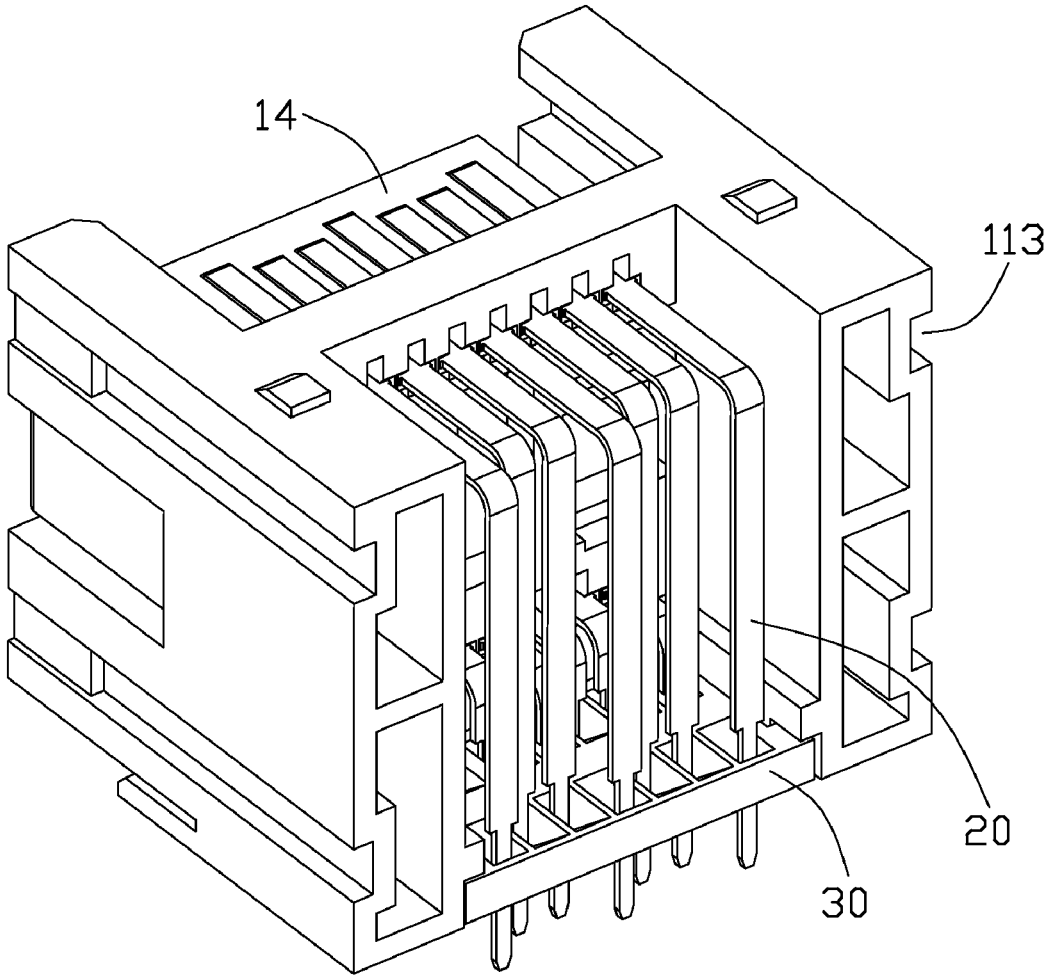
FIG. 3 is a perspective view of an electrical connector from another aspect without a metal shell assembled thereon.

Referring to FIGS. 2 and 3, the plurality of terminals 20 comprise a first or an upper array of terminals 21 and a second or a lower array of terminals 22. Each terminal 20 comprises a contact portion 201 received in a corresponding passageway 105 of the first/second tongue 14/15 for electrically contacting with the corresponding mating complementary connector, a solder tail 202 for being soldered to the printed circuit board and an intermediate portion 203 connecting the contact portion 201. Each array of terminals 21, 22 include a plurality of ground terminals 21*a*, 22*a* and a plurality of signal terminals 21*b*, 22*b* for transmitting differential signal pairs. The ground terminals 21*a*, 22*a* are longer than the signal terminals

21*b*, 22*b*. As best shown in FIG. 3, the first and the second arrays of terminals 21, 22 are staggerly arranged with respect to each other.

Figure 4:
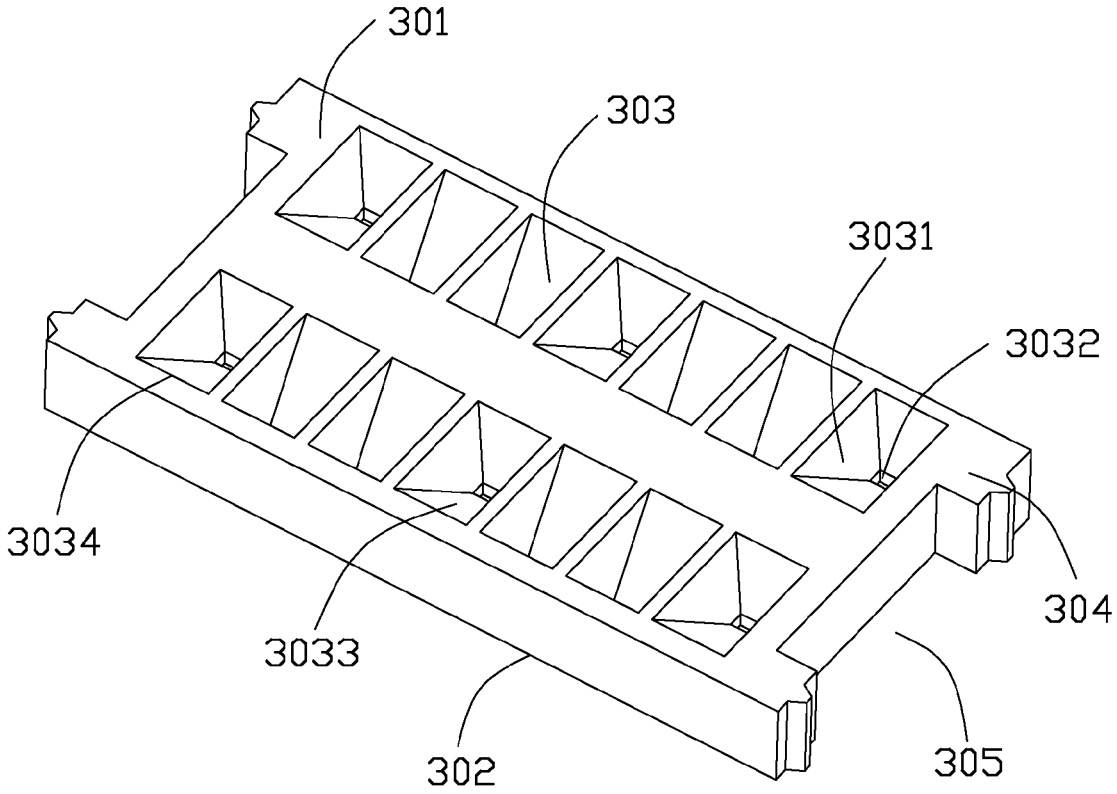
FIG. 4 is a perspective view of the spacer of the electrical connector.
Figure 5:
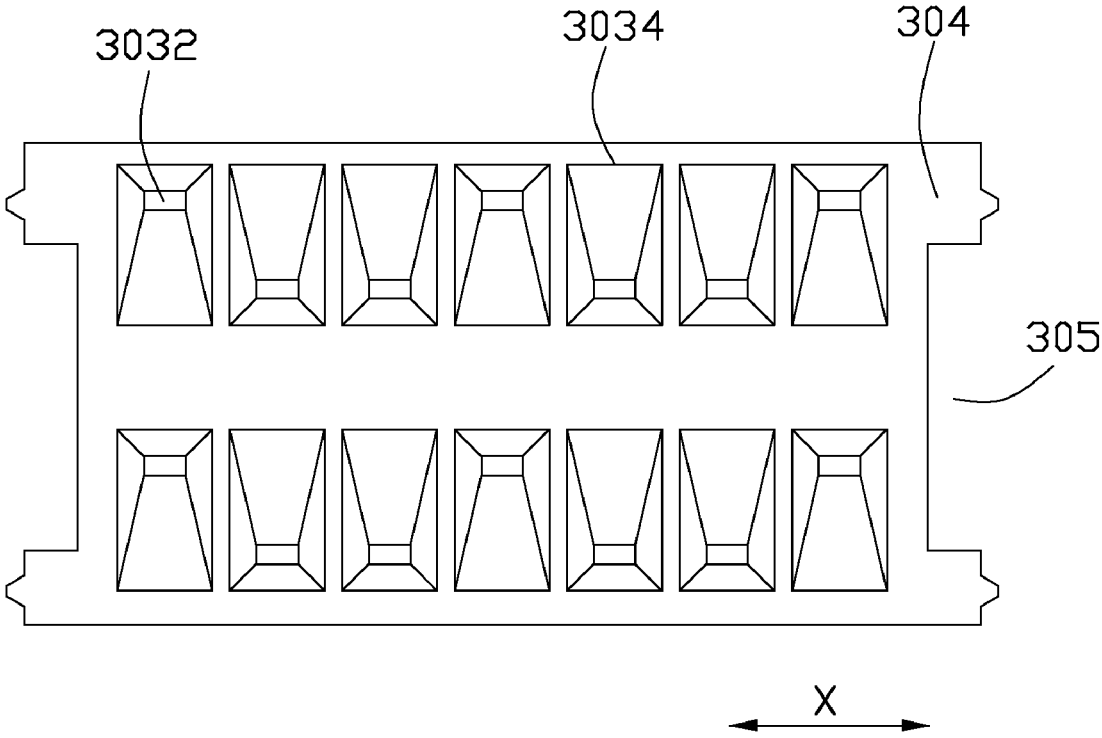
FIG. 5 is a top view of the spacer of the electrical connector.
Figure 6:
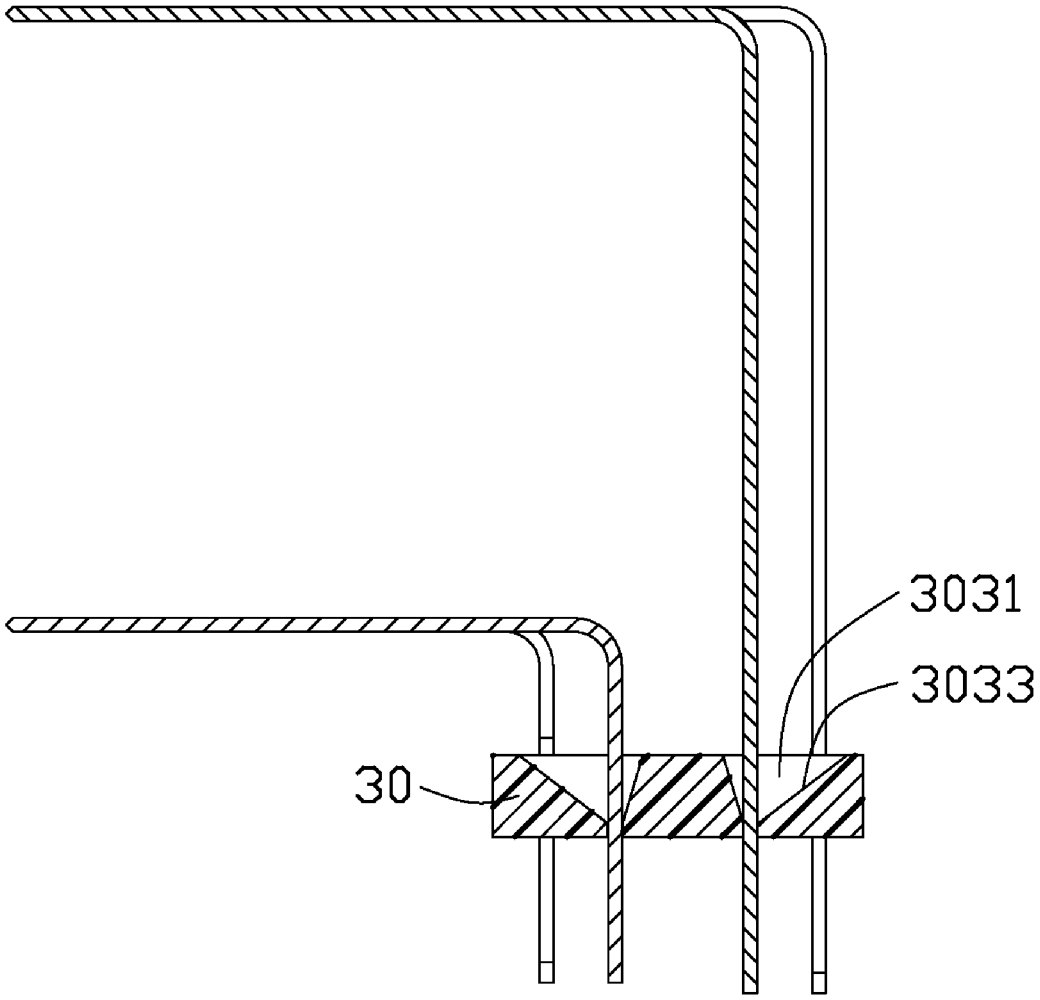
FIG. 6 is a cross sectional view of the spacer assembled with terminals.

Continuing to FIGS. 4 and 5, the spacer 30 of the connector 1 is configured to be an elongate board with a top face 301 and a bottom face 302 defined thereon. Two arrays of through holes 303 run through the top face 301 and the bottom face 302 of the spacer 30. Each through hole 303 includes an receiving hole 3032 communicating with the bottom face 302 and a guiding hole 3031 communicating with the top face 301. The guiding hole 3031 has four guiding faces 3033 which form a frame intersection 3034 together with the top face 301. The frame intersection is of square lines. It should be noted that all of the frame intersections 3034 are aligned in each array especially the frame intersection lines extending in a first direction in which the frame intersections 3034 are arranged. Meanwhile, the receiving holes 3032 are not aligned along the first direction. The receiving holes 3032 which receive the ground terminals 21*a*, 22*a* are near to an outermost side of the frame intersection 3034. The receiving holes 3032 which receive the signal terminals 21*b*, 22*b* are near to an innermost side of the frame intersection 3034. A pair of positioning portions 304 protrudes outwardly from each of two opposite sides of the spacer 30 along the first direction and defines a slot 305 therebetween. The slot 305 are correspondingly engaged with the block 111 defined on the insulative housing 10 to firmly secure the spacer 30 to the housing 10. The connector has two stacked mating ports so that the spacer has two rows of the through holes. Alternatively, the spacer can only has one row of the through holes if the connector has one mating ports.

Referring to FIG. 2, The metal shell 40 includes a top wall 401, a bottom wall 402 opposite to the top wall 401 and a pair of side walls 403 perpendicular to the top wall 401. A receiving space 404 is defined by the top, bottom and side walls to receive the insulative housing 10. A pair of spring arms 405 is defined on the top wall 401 and the bottom wall 402 respectively and protrudes into the receiving space 404 to push against the corresponding mating complementary connectors. A pair of retaining arms 406 protrudes from the side walls 403 into the receiving space 404 so as to prevent the insulative housing 10 from breaking away from the metal shell 40 by being retained in the grooves 113 of the housing 10.

In assembly, the plurality of terminals 20 are retained in the insulative housing 10 with the contact portions 201 correspondingly received in the passageways 105. The spacer 30 is assembled to the insulative housing 10 with the solder tail 202 inserted into the through holes 303. Before being inserted into the receiving hole 3031, the solder tail 202 of each terminal 20 can be guided by the guiding faces 3033 of the guiding hole 3032 if the terminals 20 are not aligned with the receiving hole 3031 accurately. Finally, the solder tails 202 of the terminals 20 are soldered onto a printed circuit board.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a row of terminals arranged in a first direction and comprising contact portions and soldering tails;

an insulative housing in which the contact portions of the terminal are arranged and behind which the soldering tails are arranged;

a spacer securely attached to the insulative housing to position the soldering tail, the spacer having a top face and a bottom face, a row of through holes running through the top face and the bottom face to receive the corresponding soldering tails thereof;

wherein each of through holes includes a guiding hole communicating with the top face and a receiving hole communicating with the bottom face, the guiding hole defines guiding faces intersecting with the top face to form frame intersection, the frame intersections of the row of through holes are aligned in the first direction, the receiving holes of the row of the through holes are offset in the first direction.

2. The electrical connector as claimed in claim 1, wherein the terminals include ground terminals and signal terminals.

3. The electrical connector as claimed in claim 2, wherein the receiving holes receiving the signal terminals are near to an innermost side of the frame intersections while the receiving holes receiving the grounding terminals are near to an outermost side of the frame intersections.

4. The electrical connector as claimed in claim 1, wherein the frame intersections of the spacer are same with each other.

5. An electrical connector for mounting to a printed circuit board, comprising:

an insulative housing;

a plurality of first type and second type contacts disposed in the housing, each of said first type and second type contacts defining a tail section extending along a vertical direction for extending into a corresponding through hole in the printed circuit board, the tail sections of said first type contacts arranged in a first row and those of the second type contacts being arranged in a second row spaced for the first row in a side view; and an insulative spacer associated with the housing and defining opposite top and bottom surfaces, a plurality of alignment holes extending, in the vertical direction, through both the top surface via corresponding top outlets, and the bottom surface via corresponding bottom outlets, wherein said bottom outlets of the alignment holes in the bottom surfaces are small for retention and arranged in two rows, under condition that the outlets in said two rows are not overlapped with each other in said side view, to snugly receive the tail sections of the corresponding first and second contacts in said two rows, while said top outlets of the alignment holes in the top surface are large for guiding under condition that the top outlet which guides the tail section of the first type contact is at least partially overlapped with the top outlet which guides the tail section of the second contacts in the side vie; wherein the top outlets of the first type contacts and those of the second type contacts are dimensioned, configured and arranged to be aligned with one another in one row.

6. The electrical connector as claimed in claim 5, wherein in the alignment hole receiving the tail section of the first type contact is offset from a center of the corresponding top outlet in a first direction while in the alignment hole receiving the tail section of the second type contact is offset from the center of the corresponding top outlet in a second direction opposite to the first direction.

7. The electrical connector as claimed in claim 5, wherein each alignment hole between the top outlet and the bottom outlet, forms therein a pair of first guiding interior surfaces which are spaced from each other in a transverse direction parallel to said two row and perpendicular to the vertical direction, and a pair of second guiding surfaces which are spaced from each other in a front-to-back direction perpendicular to both said transverse direction and said vertical direction, under condition that the first pair of guiding interior surfaces are symmetrical to each other while the second pair of guiding interior surface are not.

8. The electrical connector as claimed in claim 5, wherein said spacer is directly attached to the housing.

9. An electrical connector for mounting to a printed circuit board, comprising:

an insulative housing;

a plurality of first type and second type contacts disposed in the housing, each of said first type and second type contacts defining a tail section extending along a vertical direction for extending into a corresponding through hole in the printed circuit board; and an insulative spacer associated with the housing and defining opposite top and bottom surfaces, a plurality of first type and second type alignment holes extending, in the vertical direction, through both the top surface via corresponding top outlets, and the bottom surface via corresponding bottom outlets, wherein said bottom outlets of the first type and second type alignment holes in the bottom surfaces are small for respectively retaining tail sections of the corresponding contacts, while said top outlets of the first type and the second type alignment holes in the top surface are large for guiding the tail sections of the corresponding contacts under condition that in the first type alignment hole the bottom outlet is offset from a center of the top outlet in a first direction while in the second type alignment hole the bottom outlet is offset from the center of the top outlet in a second direction opposite to the first direction;

wherein each alignment hole between the top outlet and the bottom outlet, forms therein a pair of first guiding interior surfaces which are spaced from each other in a transverse direction parallel to said two row and perpendicular to the vertical direction, and a pair of second guiding interior surfaces which are spaced from each other in a front-to-back direction perpendicular to both said transverse direction and said vertical direction, under condition that the pair of first guiding interior surfaces are symmetrical to each other while the pair of second guiding interior surface are not.

10. The electrical connector as claimed in claim 9, wherein the top outlets of both said first type and second type alignment holes are arranged in one row while the bottom outlets of both said first type and second type alignment holes are arranged in two rows, respectively.

11. The electrical connector as claimed in claim 9, wherein said spacer is directly attached to the housing.

* * * * *